US005323757A

United States Patent [19]

Humphrey

[11] Patent Number: 5,323,757

[45] Date of Patent: Jun. 28, 1994

[54] PORTABLE STOVE MOUNTING APPARATUS

[76] Inventor: Doyce Humphrey, P.O. Box 405, Westport, Conn. 06881

[21] Appl. No.: 50,891

[22] Filed: Apr. 21, 1993

[51] Int. Cl.[5] ..... F24C 15/30

[52] U.S. Cl. ..... 126/24; 126/40; 126/277

[58] Field of Search ..... 126/24, 39 R, 40, 277

[56] References Cited

U.S. PATENT DOCUMENTS 4,729,535 3/1988 Frazier et al. ..... 126/24

5,203,317 4/1993 James ..... 126/40

*Primary Examiner*—Carroll B. Dority

*Attorney, Agent, or Firm*—Lackenbach Siegel Marzullo Aronson & Greenspan

[57] ABSTRACT

A mounting apparatus for removably securing a portable stove to a fixture of a motor vehicle or boat includes a portable stove having a generally rectangular box shaped frame, a fileting board having a flat, generally rectangular upper surface portion and at least one side wall portion extending upward from one edge of the surface portion of the board. A first fastening means operably connects between the stove and the fileting board for removably fastening the stove and board together and preventing said stove from sliding off of the fileting board. The first fastening means includes a pair of elongated tang members each having one end fastened to the stove and another end extending through one of two apertures in the one side wall portion. A second fastening means operably connects between the fileting board and the boat fixture for removably securing said board to the fixture. This second fastening means comprising a pair of opposing spaced grooves in the underside of the upper surface portion of the board and a third groove extending between the pair of grooves at one end thereof, a flat flange member received in the grooves and fixedly mounted to said fixture of the boat.

18 Claims, 4 Drawing Sheets

PORTABLE STOVE MOUNTING APPARATUS

BACKGROUND OF THE INVENTION

1. Field of the Invention

This invention relates generally to a mounting apparatus and more particularly to a portable stove mounting apparatus for use in land or marine vehicles.

2. Description of the Related Art

Portable stoves for camping and boating use are generally carried or stored between uses, and therefore must be relatively small and light. Typically, these stoves utilize butane or propane from tanks or bottles carried inside the stove itself. The stove is usually placed on the ground or on a table, lighted and used.

Stoves that are used aboard a boat or in a motor home may present a severe hazard if they are not bolted down or otherwise secured in the position of use. Marine stoves are often bolted to a table or other support structure. Stoves in motor homes or campers are merely set in place as they are not normally used while the vehicle is in motion. However, bolted stoves are inconvenient to move. They also take up a certain amount of space that could otherwise be efficiently used for food preparation and other purposes.

Alternatively, the portable stove may be fitted with suction cups on the four feet of the stove. These suction cups are designed to removably fasten the stove in place to prevent the stove from sliding across the table when the boat pitches and rolls at sea. However, such suction cups require the mounting surface or table to be mirror smooth in order to effect an adequate seal to preclude the cups from coming loose. Such a smooth surface is seldom available. In addition, the suction afforded by these cups may degrade over time so that an initially secure mount to a table may eventually become loose without warning.

Accordingly, there is a need for a simple means for removably securing a portable marine or camping stove securely in place that does not permanently usurp a work surface or food preparation surface.

There is also a need for an apparatus that removably provides a food preparation surface as well as a support for a portable marine stove that can readily be installed and removed on boats that do not have a galley or permanent cooking area.

SUMMARY OF THE INVENTION

It is therefore an object of the invention to provide an apparatus for mounting a portable stove that is easily removable without the aid of hand tools.

It is another object of the invention to provide a stove mounting apparatus in which the stove is removably secured to a fileting board or table with a hair pin cotter pin.

It is a further object of the invention to provide an apparatus for mounting a stove to a fileting board which is also removably mounted to a permanent fixture of the vehicle.

It is a further object of the invention to provide a stove mounting apparatus which removably mounts to a horizontal railing fixture.

It is a further object of the invention to provide a stove mounting apparatus which removably mounts to a horizontal surface.

The stove mounting apparatus in accordance with the invention basically comprises a flat fileting table or board which has a horizontal portion and at least one, and preferably three, vertical side wall portions, a stove, a connecting means for securing the fileting board to a fixed part of the vehicle or boat, and a connecting means for securing the stove to the fileting board. A first preferred embodiment of the apparatus in accordance with the invention has an aperture through the vertical side wall and an elongated member having one end fastened to the stove and the other end extending through an aperture through the side wall. This end is locked in place by an interference key member which prevents withdrawal of the elongated member. A second embodiment has a magnetic strip cemented to the side wall of the fileting board which butts against a steel portion of the side of the stove to magnetically secure the stove to the fillet board.

Each of these embodiments further includes a removable mounting means for securing the fileting board to a stationary fixture of the boat or other vehicle. The fixture may preferably be a flat, horizontal surface or a tubular railing member. The removable mounting means is preferably a pair of hinged "C" shaped clamps for use on a tubular railing or a grab bar.

These and other advantages, features and objects of the present invention will become more apparent from a reading of the following Detailed Description when taken in conjunction with the several sheets of Drawing.

BRIEF DESCRIPTION OF THE INVENTION

DETAILED DESCRIPTION OF THE INVENTION

Figure 1:
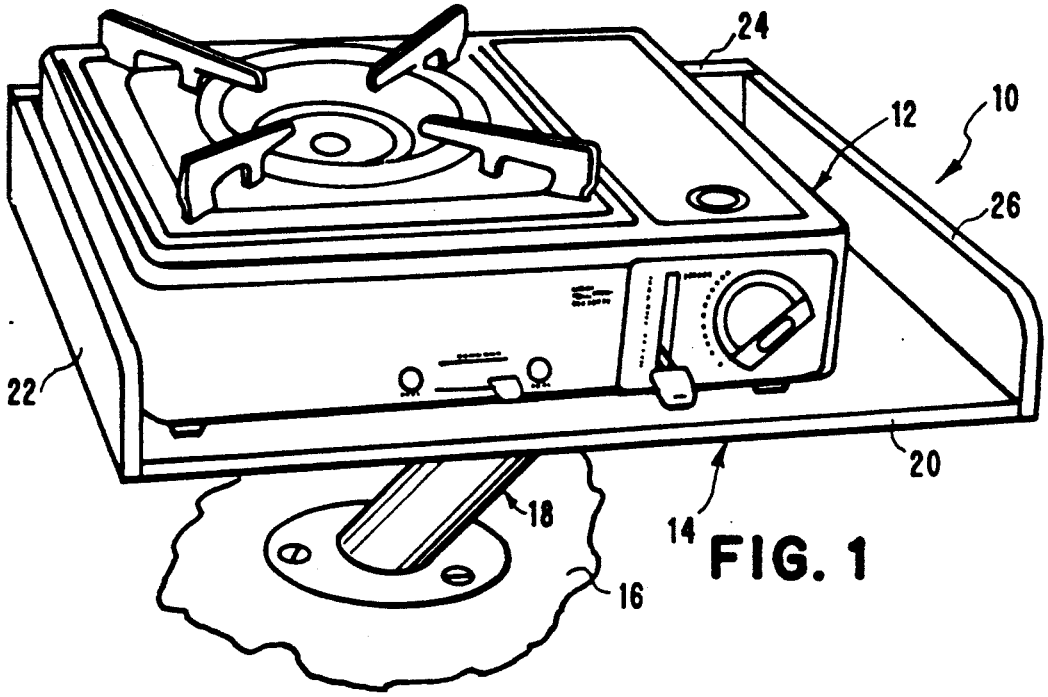
FIG. 1 is a perspective view of a first embodiment of the portable stove mounting apparatus in accordance with the invention.

A perspective view of a store mounting apparatus 10 in accordance with the invention is shown in FIG. 1. A portable stove 12 sets on a fileting board 14. The board 14 is in turn removably mounted to a portion of a boat deck 16 in accordance with the invention via a flanged stanchion 18.

Figure 2:
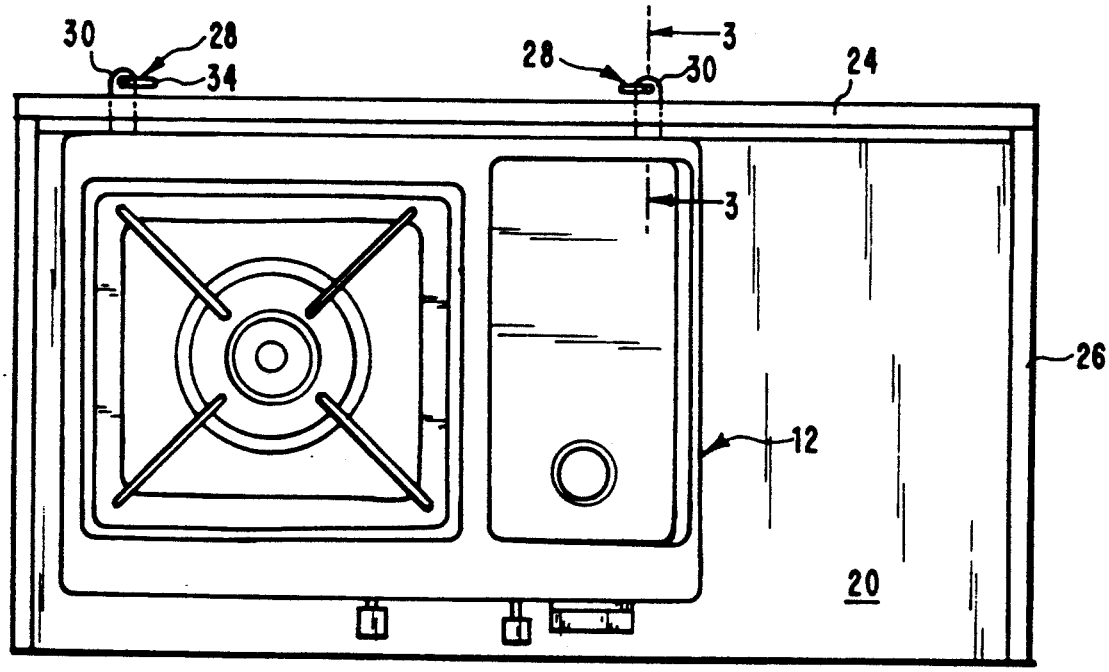
FIG. 2 is a top view of the first embodiment of the invention shown in FIG. 1.

The fileting board 14 has a flat rectangular table portion 20 and three side wall portions 22, 24, and 26 which extend upward orthogonally from the edges of the table portion 20. As is shown in FIG. 2, the back side wall portion 24 may be slightly spaced from the table portion 20 and only fixed to the side wall portions 22 and 26. The table portion may also be fixed to the back wall 24 for added rigidity to the fileting board.

Figure 3A:
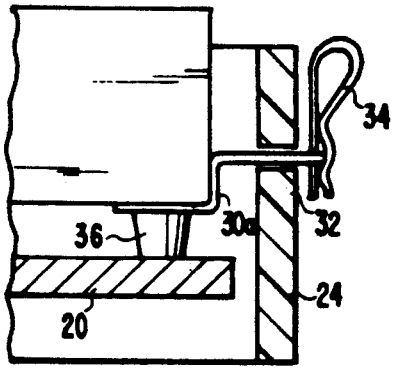
FIG. 3A is a partial vertical sectional view of the first embodiment shown in FIG. 2 taken along the line 3—3.

The stove 12 has a generally rectangular, box shaped frame with four rubber feet positioned at the four corners of the frame. The stove 12 is removably secured to the fileting board 14 by at least one first fastening means 28. In the first embodiment shown in FIGS. 1 and 2, the fastening means 28 includes two offset tangs 30. These tangs 30 extend from the stove 12 up the side of the stove and then outward to protrude through apertures 32 in the back side wall portion 24 of the fileting board 14 as is shown in FIG. 2. Each of the tangs 30 is in turn held in place on the back side of the back wall 24 by a hair pin cotter pin 34 as is shown in FIG. 3A. This hair pin cotter pin fits through a hole at the end of the tang 30 and prevents withdrawal of the tang until the pin is removed.

Figure 3B:
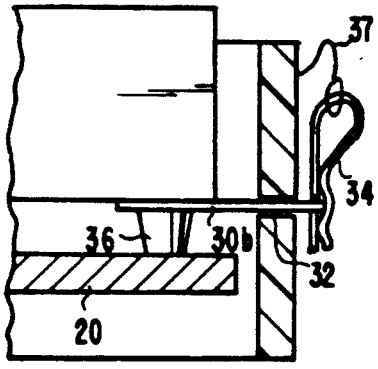
FIG. 3B is a partial vertical sectional view of an alternative first embodiment taken along the line 3—3 in FIG. 2.
Figure 3C:
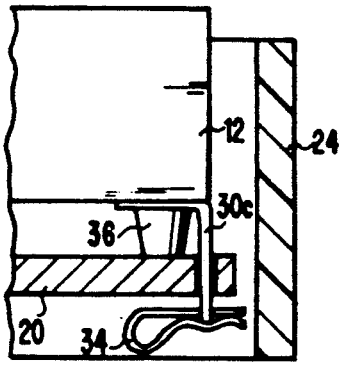
FIG. 3C is a partial vertical sectional view of a second alternative to the first embodiment taken along the line 3—3 in FIG. 2.

Alternative arrangements of the securing means 28 are shown in FIGS. 3A, 3B, and 3C. These embodiments utilize different shapes of tang 30, designated 30*a*, 30*b*, and 30*c*. In 3A, tang 30*a* is offset, that is, it has two horizontal end portions and a vertical mid portion. Each end portion has a hole through it. One end portion is fastened to the stove 12 between the stove foot 36 and the stove with the screw (not shown) that holds the foot 36 to the stove 12. The other end portion of the tang 30*a* extends horizontally through the aperture 32. In FIG. 3B, tang 30*b* is a flat elongated bar which has a hole at each end. One end is fastened between the stove and the stove foot and the other end extends through the aperture 32 in the back side wall. In FIG. 3C, the tang 30*c* is an "L" shaped bar which has its short end attached to the stove 12 at the foot 36. The longer end extends through an aperture 38 in the table portion rather than the back wall 24. This arrangement might be desired if access to the rear of the back wall 24 is restricted.

The embodiment of the securing means 28 shown in FIG. 3A may be desirable where the stove is to be spaced from the wall portion 24. In this case, end portion fixed to the stove foot would be longer and the vertical mid portion of the tang 30 would thus be spaced from the stove 12 and against the inside surface of the back wall 24. The embodiment shown in FIG. 3C could also be used to achieve the same result. The embodiments shown in FIGS. 3A and 3B may also have longer tangs 30 with a plurality of holes in the tang 30 to adjust the spacing between the stove 12 and the back wall 24. In this case, a second hair pin cotter pin (not shown) would be placed through a hole in the tang 30 on the inside of the back wall 24. Another alternative, also not shown, would be for the tangs 30 to extend the stove feet to the side of the stove 12 and extend through apertures in either of the side walls 22 or 26. These alternatives are not illustrated but are equivalent to the embodiments shown.

Figure 4:
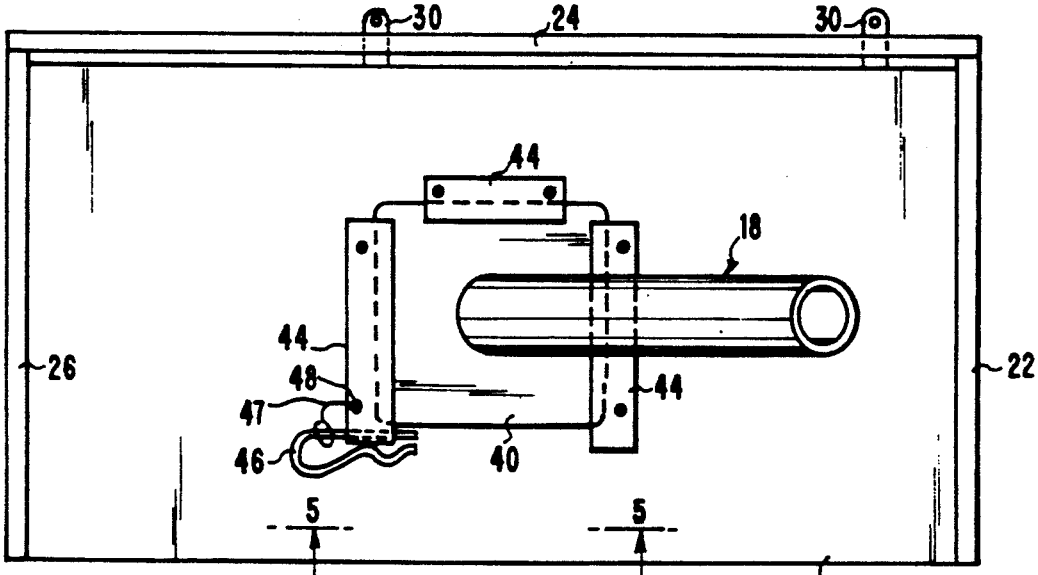
FIG. 4 is a bottom view of the apparatus of the present invention shown in FIG. 1.
Figure 5:
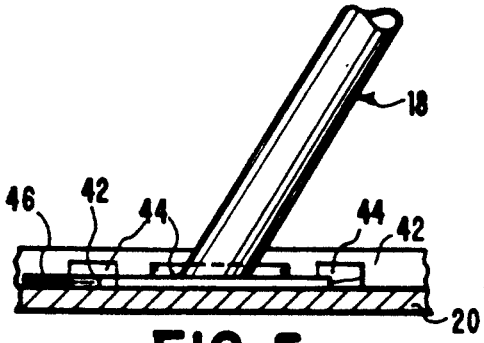
FIG. 5 is a partial sectional view taken along the line 5—5 in FIG. 4.

A second securing means, for removably securing the fileting board to a fixture of the boat or other vehicle is shown in FIG. 4. FIG. 4 is a bottom view of the fileting board 14. A stanchion 18 extending from the deck 16 of a boat has a flat, generally rectangular, horizontally positioned top flange 40. This top flange 40 slides into corresponding spaced grooves 42 in the underside of the fileting board 14. These grooves may be integrally formed in the board 14 or may be formed by rabbeted cleats 44 screwed and glued to the underside of the board 14 as shown in FIGS. 4 and 5. The flange 40 is held in place in the grooves 42 by another hair pin cotter pin 46 which fits into a bore through one of the cleats 44 and extends into the groove 42 to prevent movement of the flange 40 as shown in FIG. 5.

Figure 6:
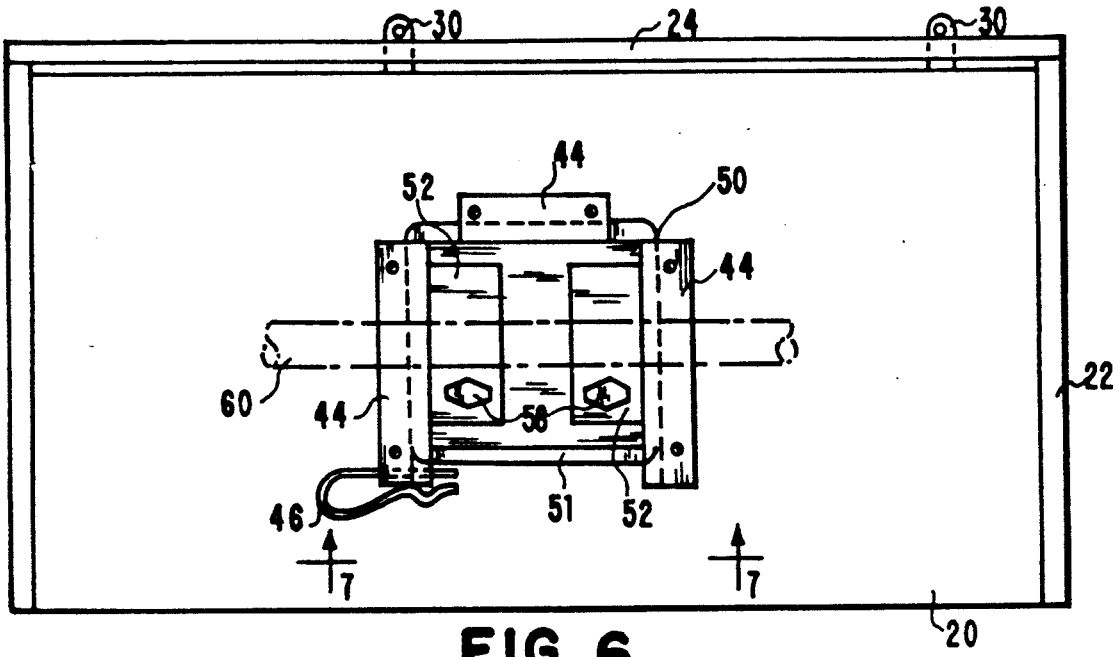
FIG. 6 is a bottom view of a second embodiment of the apparatus in accordance with the present invention.
Figure 7:
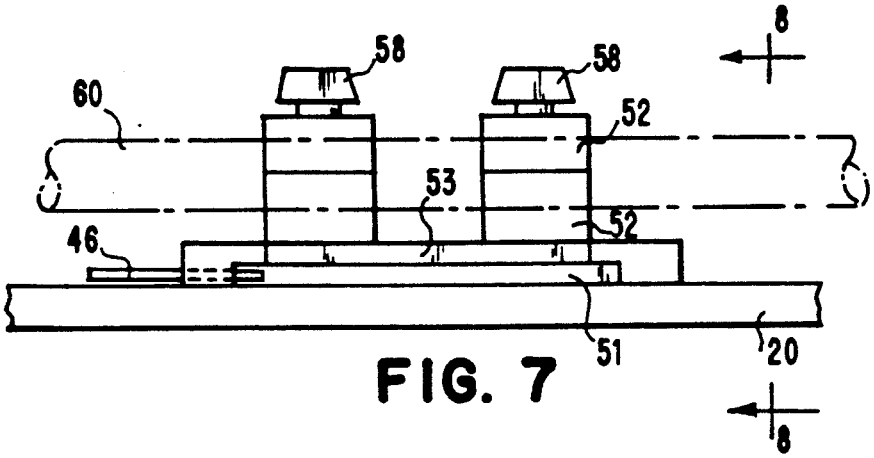
FIG. 7 is a partial side view of the second embodiment shown in FIG. 6 taken along the line 7—7 in FIG. 6.
Figure 8:
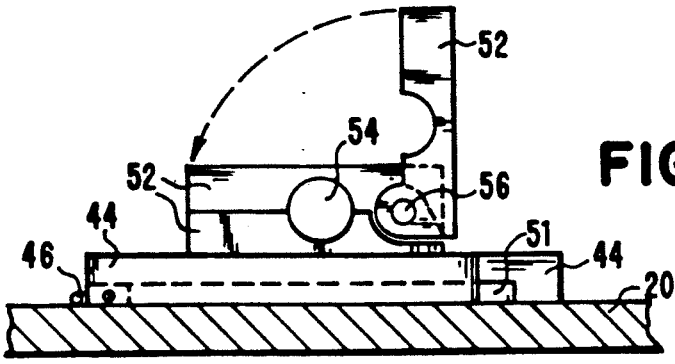
FIG. 8 is a side view of the second embodiment shown in FIG. 6 taken along the line 8—8 in FIG. 7.

If the fileting board 14 and stove 12 are to be secured to a horizontal tubular railing 60, the second securing means is a clamp assembly 50 used in place of the flanged stanchion 18. The clamp assembly 50 is shown in FIGS. 6 through 8. The clamp assembly 50 comprises a flange 51 similar to the flange 40 just described, a clamping plate 53 fixed to the flange 51, and two pairs of spaced jaw members 52 that each have a straight arcuate bottomed groove 54 in one face. One jaw member 52 of each pair is fixed to the clamping plate 53. The other is movable and has one end pivotally connected to the fixed jaw 52 by a pin 56. The opposite ends of the jaws 52 are fastened together by thumb screws 58 as shown in FIG. 7.

The flange 53 slides in grooves 42 as in the embodiment just described and is also held in the grooves 42 by a hair pin cotter pin 46. The radius of the groove 54 should be the same as that of the tubular railing 60 upon which the assembly 50 is to be mounted. The depth of the groove 54 should be less than the radius of the railing so that a firm compressive grip may be established between the jaws 52 when the thumb screws 58 are tightened. Once the clamp assembly 50 is installed on the railing 60, the fileting board 14 may be installed and removed simply by sliding the board onto the flange 53 and securing it in place with a hair pin cotter pin 46 as previously described.

Figure 9:
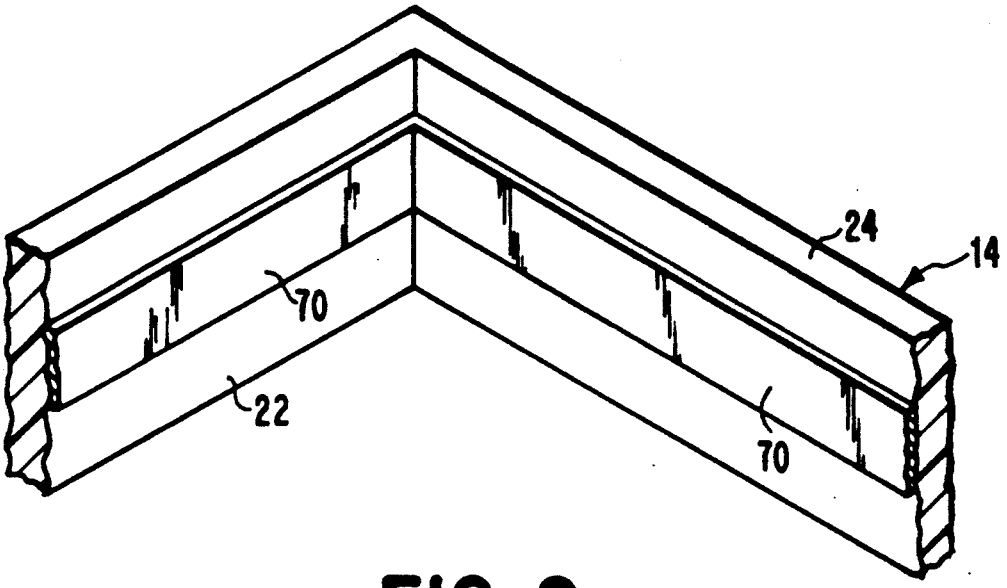
FIG. 9 is a partial perspective sectional view of the vertical side wall portion of the fileting board showing a third embodiment of the fastening apparatus in accordance with the invention.

FIG. 9 shows an alternative first securing means for securing the stove 12 to the fileting board 14. In this alternative, a magnetic strip 70 is adhesively or otherwise fixed to the side and back wall portions 22 and 24. This strip 70 will magnetically hold the stove 12 in the corner between the wall portions 22 and 24 provided the body of the stove is made of steel sheet metal material.

Figure 10:
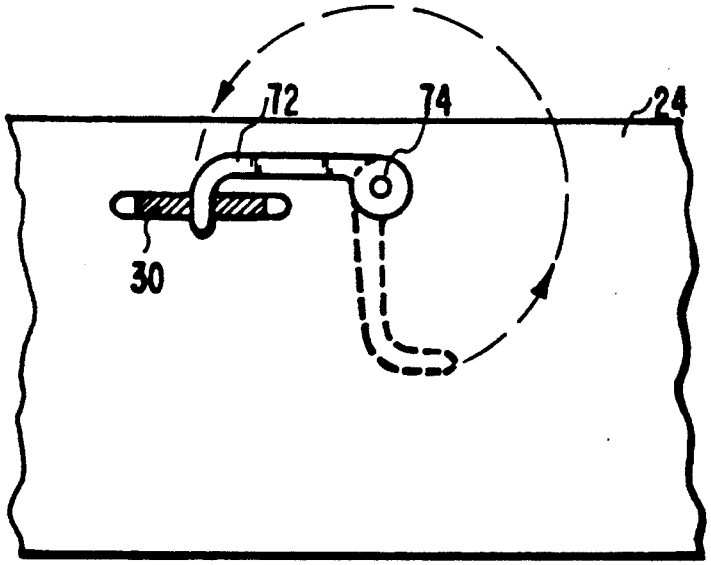
FIG. 10 is a partial rear view of the apparatus shown in FIG. 1 showing an alternative fastening device for the first embodiment.

FIG. 10 shows an alternative to the hair pin cotter pin 34 above described in the various embodiments. The tang 30 may be secured to the back wall portion 24 by a hook 72 which is swivelly mounted to the wall 24 by a screw 74. This arrangement would prevent the loss of the cotter pin, although other loss prevention means could be employed such as tethering the cotter pin to the wall portion 24. For example, a tether 37 as shown in FIG. 3B can be used to connect the hair pin cotter pin 34 to the back wall portion 24. Similarly a tether 47 as shown in FIG. 4 can be used to connect the hair pin cotter pin 46 to one of the screws 48 securing cleat 44 to the underside of the flat rectangular table portion 20.

While the above description is illustrative of the preferred embodiments of the present invention, it will be appreciated that the inventive concept of the portable stove mounting apparatus in accordance with the invention may be practiced otherwise than as specifically described. Thus the embodiments of the invention are subject to modification, variation and change without departing from the proper scope and fair meaning of the appended claims. Accordingly, it is intended to embrace all such changes, modifications and variations that fall within the spirit and broad scope of the appended claims. All patent applications, patents and other publications cited herein are incorporated by reference in their entirety.

What is claimed is:

1. A mounting apparatus for removably securing a portable stove to a fixture of a vehicle, comprising:

a portable stove having a generally rectangular box shaped frame and at least one burner mounted in said box shaped frame;

a fileting board having a flat, generally rectangular upper surface portion and at least one side wall portion extending orthogonally upward from one edge of said surface portion of said board;

a first fastening means operably connected between said stove and said fileting board for removably fastening said stove and board together and preventing said stove from sliding off of said fileting board, said first fastening means comprising an elongated tang member having one end fastened to said stove and another end extending through an aperture in said one side wall portion;

a second fastening means operably connected between said fileting board and said vehicle fixture for removably securing said board to said fixture; and said first and second fastening means being hand operable without the aid of hand or power tools.

2. The apparatus according to claim 1 wherein said vehicle is a boat.

3. The apparatus according to claim 3 wherein said another end has a hole through said end and a pin extending through said hole to prevent said tang from being pulled back through said wall portion.

4. The apparatus according to claim 3 wherein said pin is a hair pin cotter pin.

5. The apparatus according to claim 3 wherein said pin is a hook having one end swivelly attached to said wall portion and a hook end operative to engage said hole in said tang.

6. The apparatus according to claim 3 wherein said tang is a flat, elongated sheet metal body having opposite parallel ends extending in opposite directions and a mid portion connecting the ends.

7. The apparatus according to claim 3 wherein said tang is a straight sheet metal body.

8. The apparatus according to claim 3 wherein said tang is an "L" shaped sheet metal body extending from said stove.

9. The apparatus according to claim 3 wherein said second securing means comprises a pair of opposing spaced grooves in the underside of said upper surface portion and a third groove extending between said pair of grooves at one end thereof, a flat flange member fixedly mounted to said vehicle, said flange having edges adapted to slide into and between said pair of grooves to a stopped position in said third groove.

10. The apparatus according to claim 9 wherein said grooves are rabbets formed along one edge of rectangular block shaped cleats attached to the underside of said upper surface portion.

11. The apparatus according to claim 10 further comprising a retaining pin adapted to fit through a bore through one of said cleats and against said flange to prevent movement of said flange out of said grooves.

12. A mounting apparatus for removably securing a portable stove to a fixture of a boat comprising:

a portable stove having a generally rectangular box shaped frame, a fuel supply and at least one burner mounted in said box shaped frame;

a fileting board having a flat, generally rectangular upper surface portion and at least one side wall portion extending upward from one edge of said surface portion of said board;

a first fastening means operably connected between said stove and said fileting board for removably fastening said stove and board together and preventing said stove from sliding off of said fileting board comprising a pair of elongated tang members each having one end fastened to said stove and another end extending through one of two apertures in said one side wall portion;

a second fastening means operably connected between said fileting board and said boat fixture for removably securing said board to said fixture, said second fastening means comprising a pair of opposing spaced grooves in the underside of said upper surface portion and a third groove extending between said pair of grooves at one end thereof, a flat flange member fixedly mounted to said fixture of said boat, said flange having edges adapted to slide into and between said pair of grooves to a stopped position in said third groove;

a pair of hand removable pin members each extending through a hole through said tangs extending through said wall portion to prevent movement of said tangs back out of said apertures; and a third hand removable pin member passing through one of said grooves operably engaging said flange to prevent movement of said flange from said grooves.

13. The apparatus according to claim 12 wherein said grooves are rabbets formed along one edge of each of three rectangular block shaped cleats attached to the underside of said upper surface portion.

14. The apparatus according to claim 13 wherein said third pin is adapted to fit through a bore through one of said cleats and abut against said flange to prevent movement of said flange out of said grooves.

15. The apparatus according to claim 14 further comprising a tubular stanchion having one end fixed to said flange and the other end fixed to a deck portion of said boat.

16. The apparatus according to claim 14 further comprising a clamping assembly attached to said flange for mounting said apparatus to a tubular railing fixture on said boat, said clamping assembly comprising a spaced pair of fixed jaws attached to said flange and a pair of movable jaws each pivotally mounted at one end to one of said fixed jaws so as to receive said railing fixture between said jaws, each movable jaw having a clamp thumb screw operable to squeeze said movable and fixed jaws together to clamp said railing fixture therebetween.

17. The apparatus according to claim 16 wherein said pins are hair pin cotter pins.

18. The apparatus according to claim 12 wherein at least one of said pin members is tethered to one of said wall or board portions.

* * * * *